US005724791A

United States Patent [19]

Pishny et al.

[11] Patent Number: 5,724,791

[45] Date of Patent: Mar. 10, 1998

[54] DYNAMIC MOTION CONTROL SYSTEM AND METHOD FOR TRANSFERRING DOCUMENTS

[75] Inventors: Jeff M. Pishny, Folsom; Marc J. Fagan, Davis; Remesh Kuruppath, Sacramento; Steven L. Mulkey, Cameron Park; Jonathan D. Emigh, Somerset, all of Calif.

[73] Assignee: United States Computer Services, Sacramento, Calif.

[21] Appl. No.: 403,335

[22] Filed: Mar. 14, 1995

[51] Int. Cl.[6] ..... B65B 57/14; B65B 59/02

[52] U.S. Cl. ..... 53/501; 53/495; 53/569; 53/131.2

[58] Field of Search ..... 53/501, 500, 55, 53/52, 495, 493, 460, 569, 206, 284.3, 247, 237, 154, 540, 411, 131.4, 131.2

[56] References Cited

U.S. PATENT DOCUMENTS

| | | | |
|---|---|---|---|
| 3,490,761 | 1/1970 | Bell | 53/495 X |
| 4,604,704 | 8/1986 | Eaves et al. | 53/495 X |
| 4,739,606 | 4/1988 | Cantile | 53/569 X |
| 4,962,840 | 10/1990 | Miura et al. | 53/501 X |
| 4,987,547 | 1/1991 | Rabindran et al. | 53/55 X |
| 5,510,997 | 4/1996 | Hines et al. | 53/493 X |

*Primary Examiner*—James F. Coan

*Attorney, Agent, or Firm*—James M. Ritchey

[57] ABSTRACT

A system for coordinating an operational speed of an envelope inserter receiving incoming packets containing a predetermined number of document pages with an interval of time required to generate each incoming packet. A printer generates the document pages within each of the packets and a computer coordinates the operational speed of the envelope inserter with the interval of time required by the printer to generate each incoming packet.

15 Claims, 3 Drawing Sheets

DYNAMIC MOTION CONTROL SYSTEM AND METHOD FOR TRANSFERRING DOCUMENTS

BACKGROUND OF THE INVENTION

1. Field of the Invention

A system for decreasing wear and tear or mechanical degradation on an envelope inserting apparatus and thereby increasing the life of the envelope inserting apparatus. The envelope inserting apparatus or transferring means (transferring in the sense of taking the incoming documents and inserts from the moving means or folder, assembling the mail items, and transferring the mail items to any further processing equipment) is coupled to means for printing document packets which are moved to the inserting apparatus at variable intervals. More specifically, for an inserter machine that receives packets of documents having possibly different numbers of pages within each packet and each packet is inserted into a mailing envelope, a system that efficiently coordinates the operational speed of the inserter with the period of time required to print the document pages within each incoming packet, thereby minimizing repairs to the inserter machine.

2. Description of the Background Art

Various types of envelope filling devices, known generally as inserters, exist in the field of bulk mailings. Documents are inserted into envelopes by the inserters. Documents or inserts are of numerous types, including advertisements, billing packets having one or more billing document pages within each packet, coupons, return envelopes, and the like. Some of the inserts, such as the billing packets, are often supplied to the inserter at non-constant intervals between the packets. The non-constant intervals between the supplied packets exists because more time is required to prepare or print a packet having multiple pages than a packet with one page. The total time for printing any packet depends upon the exact number of pages within that billing packet.

Existing inserters have been run in one of two traditional operation modes. First, an on-off, stop-start, or all-or-nothing type mode with the machine simply being operated at full speed when functioning. Second, a variable speed mode as determined by a rheostat type DC motor control in the inserter. In the rheostat mode the inserter was merely selected to process all of the inserts within any particular job, regardless of any variable insert supply requirements, at a speed value varying from full velocity to a machine determined minimum speed. Inserters running at high operational velocities often fail mechanically, thereby necessitating down-time for repairs. The repair down-time significantly decreases the overall efficiency of the entire bulk mailing process. Selecting operation speeds for an inserter that are slow enough to decrease repairs often significantly decrease the total number of mailing pieces that can be processed within critical time requirements. Since bulk mailing operators rely on being timely and extremely efficient to turn a reasonable profit and to compete successfully with competitors, inserter down-time is extremely detrimental.

No ability existed, prior to the subject invention, to selectively increase or decrease the inserter's processing rate. The increased and decreased processing rate is needed to accommodate different insert supply speeds, as dictated by such variables as the number of pages being printed within a billing packet. The subject invention now permits a dynamic relationship to exist between the incoming stream of inserts and the most practical or optimal operational speed of the inserter (in terms of lowering the overall duration of repair down-time and prolonging the life of the inserter). By lowering the overall speed of the inserter fewer errors are made and the life of the inserter is increased. The subject invention permits a synchronicity of the inserter speed with the speed of the incoming stream of document packets.

SUMMARY OF THE INVENTION

An object of the present invention is to provide a system that coordinates the running or operational speed of a document transferring device such as an inserter with the times required to generate or receive incoming documents packets.

Another object of the present invention is to supply a computer controlled system that minimizes, based on the length of time required to prepare incoming packets of documents, the operational time of an inserter receiving the packets.

A further object of the present invention is to furnish a system that decreases the mechanical wear on an inserter.

Yet another object of the present invention is to relate a system for optimizing the efficiency of a mailing envelope inserter apparatus, wherein the optimization is based upon coordinating the operational speed of the envelope inserter with the intervals of time required to generate or receive incoming documents which will be inserted into mailing envelopes.

Still another object of the present invention is to disclose a method of optimizing the efficiency of a document transferring device such as an inserter, wherein the optimization is based upon coordinating the operational speed of the document transferring device with the intervals of time required to generate or receive incoming documents.

Yet a further object of the present invention is to exhibit a method of optimizing the efficiency of a mailing envelope inserter apparatus, wherein the optimization is based upon coordinating the operational speed of the envelope inserter with the intervals of time required to generate or receive incoming documents which will be inserted into mailing envelopes.

Disclosed is a system for coordinating an operational speed of an envelope inserter receiving incoming packets containing a predetermined number of document pages with an interval of time required to generate or receive each incoming packet. The system comprises means for printing the document pages within each of the packets. Additionally, controller or computer means are provided for coordinating the operational speed of the envelope inserter with the interval of time required by the printing means to generate each incoming packet (or the time needed to receive an incoming packet from a stack of pre-printed pages).

The computer means is programmed with steps for determining for an incoming packet the number of document pages within the incoming packet. Further, the computer initiates operation of the inserter based on the page number determination and adjusts the operational speed of the inserter based on the page number determination.

More specifically, the computer determines for a first incoming packet the number of document pages within the first incoming packet. Also, the computer establishing for a second incoming packet following the first incoming packet the number of document pages within the second incoming packet and adjusts the operational speed of the inserter based on the page number determination for both the first and the second incoming packets.

Optionally, the computer ascertains for at least one additional incoming packet following the second incoming packet the number of document pages within the additional incoming packet and adjusts further the operational speed of the inserter based on the page determination for the additional incoming packets. Additional refinements of the subject system are noted in detail below.

Other objects, advantages, and novel features of the present invention will become apparent from the detailed description that follows, when considered in conjunction with the associated drawings.

DESCRIPTION OF THE PREFERRED EMBODIMENT

Figure 1:
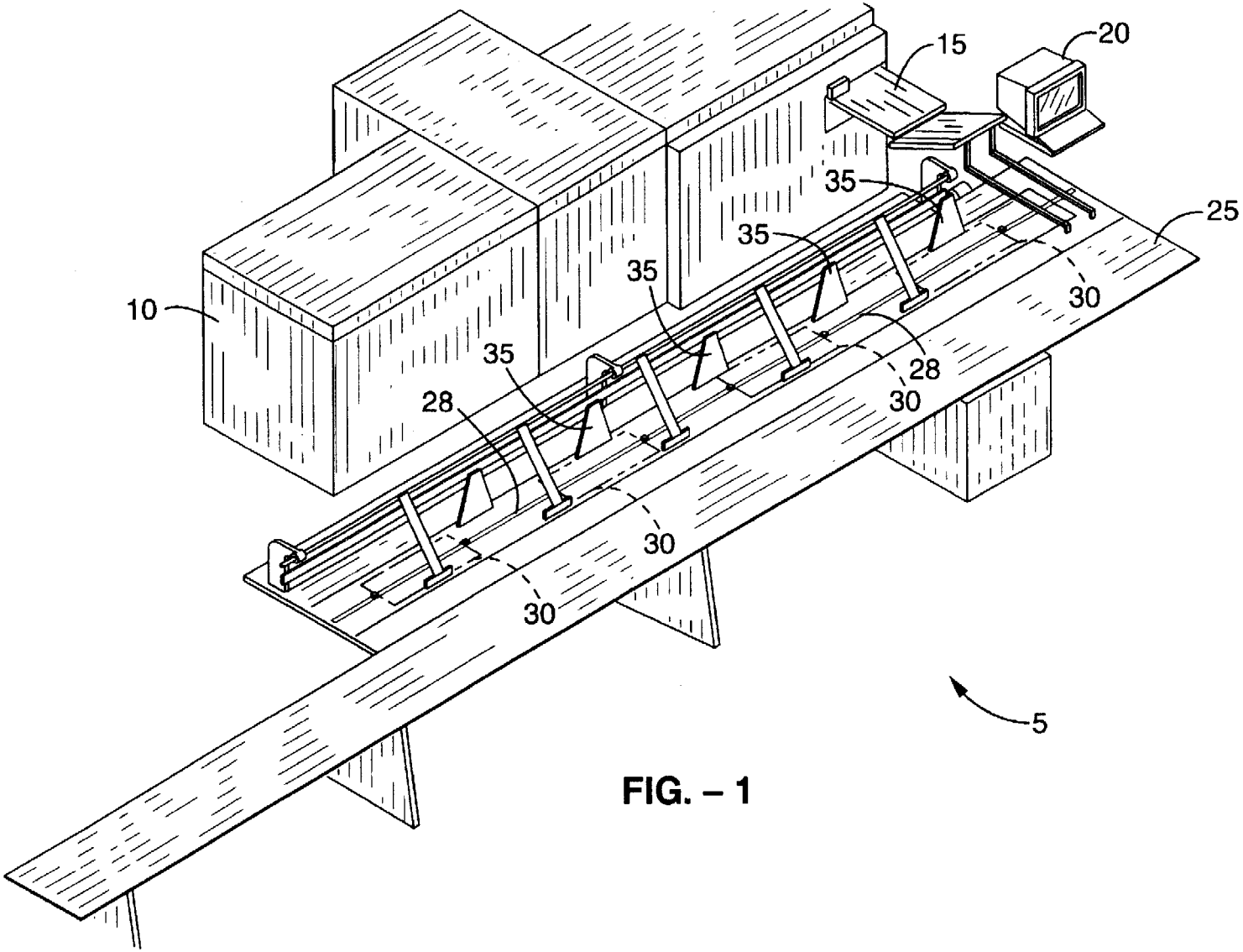
FIG. 1 is a perspective view of a typical printer, moving means or folder, controlling computer, and transferring means or mail inserter apparatus employed the subject invention.

Although the subject invention is functional with a wide variety of document transferring equipment that would benefit from operating at optimized speeds based on time intervals between incoming documents, preferably, utilization of the subject invention revolves around a typical inserter apparatus that places mailable items within a mailing envelope and associated equipment such as folders, collators, and the like. Referring now to FIG. 1, for illustrative purposes there is shown a typical insertion system 5 that is utilized for controlling, generating, moving, and transferring by including selected inserts in mailed statements. Generally, comprising the illustrative insertion system is a document preparation apparatus or printer 10, document moving means or folder 15, controlling computer 20, and transferring means or specifically a mail inserter apparatus 25 employed the subject invention.

Usually, the subject invention includes means for not only accepting already existing mail items, but for generating mail items such as a simplex or duplex printer 10. By way of example for bulk mailing situations, billing statements having one to a plurality of document pages are produced, according to prepared data, by the printer 10, folded into a proper size 30 by the folder 15, and inserted, via a conveyor belt system 28, into a mailing envelope (not shown) by the inserter 25, along with other envelope inserts held within various hoppers 35. The inserter 25 not only fills the envelope with selected documents, it transfers each mail item between the folder 15 and the next processing stage (not shown) such as packing shipping trays and the like.

Although the preferred manner for operating the subject invention is to have the printer 10 coupled immediately, via the moving means or folder 15, to the inserter 25, the printing of the documents could be done off-line and a stack of the documents with different page counts could then be sent through the moving means or folder 15 to the inserter 25. Thus, when the term "generating" a document is employed in this disclosure, it refers to situations in which the relevant documents are either printed immediately before being handled by the folder 15 or printed separately and then handled at a later time by the folder 15, under direction by the controller 20 which has information concerning the exact page count for each bill. In either case, a greater time is required to move a complete multiple page bill from the printer or stack to the inserter 25 than for a one page bill.

One example of a commercially available printer 10 which can be interfaced (via a moving means) with the inserter apparatus 25 and controlling computer 20 for use with the subject invention is the DELPHAX SYSTEMS 300IE printer and post-processing system interface.

As indicated above, the invention also includes a transferring means or inserter apparatus 25 which has means for mechanically interfacing to the printer 10. The mechanical interface means that moves the items from the printer 10 to the inserter 25 preferably includes mail item moving means in the form of a transfer tray, collator, or folder 15.

The overall subject system 5 is driven by suitable data processing means, often in the form of a microprocessor, personal computer 20, or other equivalent means, connected to the system 5 (including printer 10, inserter 25, and other associated components) by suitable and standard interfacing means for communication. Computer 20 generally includes standard data input means, such as keyboard, floppy disk drives and equivalent means, and interface cables, as well as existing or future data storage means and data display means. Preferably, the computer 20 is proximate to mail handling components of the subject invention or, optionally, located in a separate computer room to isolate the operator from noise associated with mail item preparation.

The moving means or folder 15 and the transferring means or inserter 25 are driven by integrated system controlling means, preferably in the form of integrated system controller computer 20. Interfacing communication means, preferably in the form of network linking means such as ethernet interface and parallel interface provide data communication from the printer 10 to system controller computer 20. Interfacing communication means allows control instructions from system controller computer 20 to be directed to inserter apparatus 25. The system control computer 20 generally includes means for monitoring the position and movement of mail items along the inserter apparatus 25 (similar means are usually included in the printer 10 and moving means or folder 15 for monitoring the position and movement pages within the printer 10 and folder 15). The monitoring means is typically in the form of one or more photocell detectors or other equivalent position detecting means, which note the presence or absence of mail items at particular locations on the inserter 25.

Information shared between the printer 10 and the controller 20 includes how many document pages will be present in any given billing statement packet. Since the controller 20 also operates the inserter 25, the controller 20 is in a position to maximize the efficiency of the operational speed of the inserter 25, in relation to the size of an incoming packet. A typical transferring means or inserter 25 is a PHILLIPSBURG inserter, but other equivalent machines are acceptable for use with the subject process. The speed of the inserter is determined by noting with appropriated means the position of the inserter shaft angle.

By looking "up-stream" into the oncoming flow of document packets being created by the printer 10, the subject invention permits a synchronicity of the operational speed of the inserter 25 to match the variable speed of the incoming stream of document packets from the printer 10 which is generally the time required to receive the packets. Generally, the controller 20 "looks" or processes page count and timing factors for: 1) the packet arriving at the inserter 25 from the printer 10; 2) the packet being generated by the printer 10 which will immediately follow item 1; and 3) the packet that is produced by the printer 10 which will immediately follow item 2. Should a preprinted stack of document pages be utilized instead of freshly printed pages, the controller 20 would adjust to process suitable page count and timing factors for the moving of the pages from the stack to the inserter 25 or generally the time required to receive the pages from the stack. The controller 20 analyzes the information, in view of a subject algorithm, described by example below, and adjusts the speed of the inserter 25. If a "finer tuning" for the operational speed of the inserter 25 is required or desired, the subject controller 20 may look even further up-stream than only the next packet to be produced and incorporate this data into the process.

Figure 2:
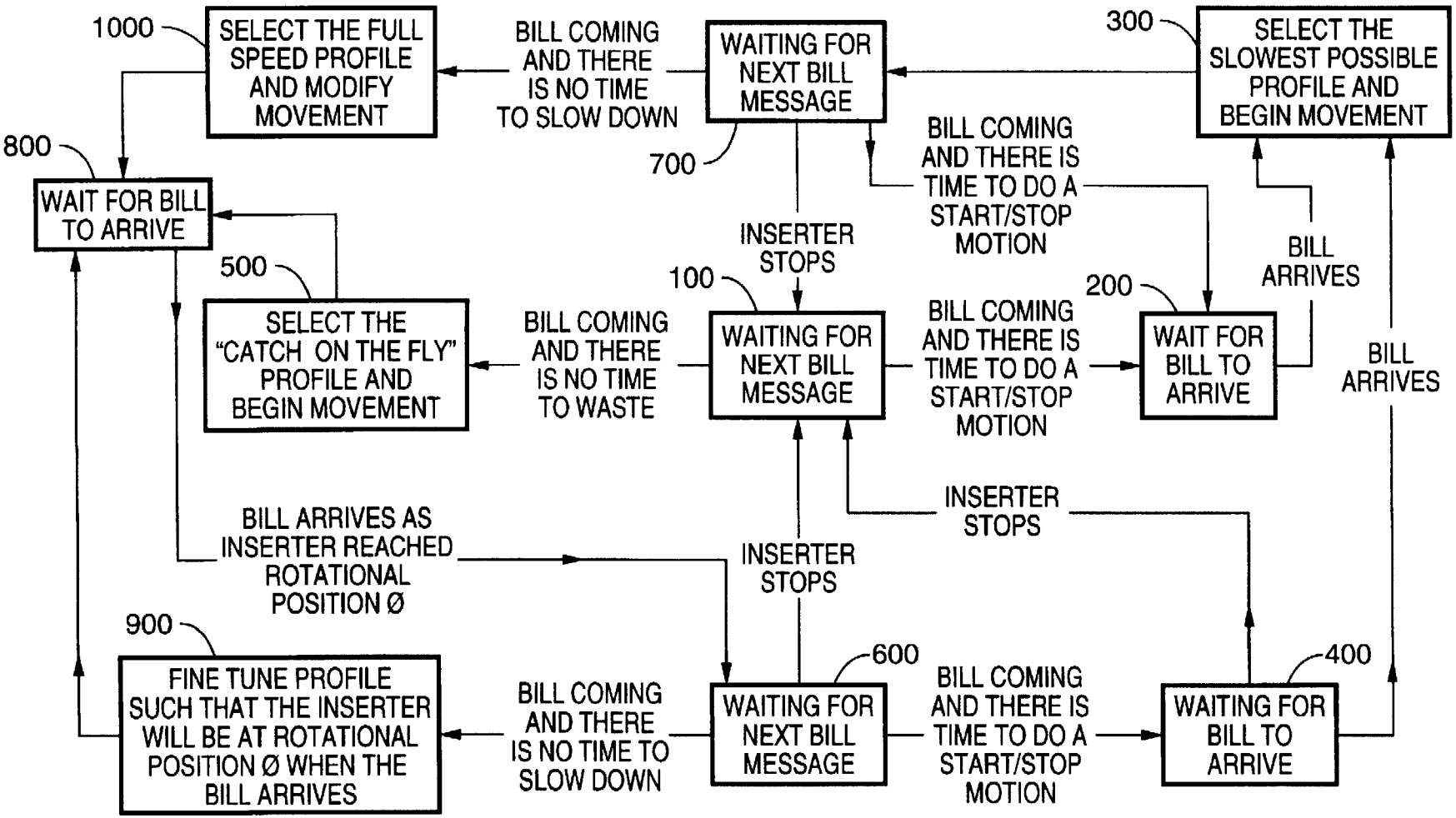
FIG. 2 is a state diagram or machine illustrating the operational steps comprising an embodiment of the subject invention.

Specifically, FIG. 2 shows a state diagram or machine illustrating the typical operational steps comprising a preferred embodiment of the subject invention and initiated by the controller 20. The system controller or computer 20 is programmed with an algorithm that starts the operation of and controls the speed of the transferring means or inserter 25 in a manner that produces an inserter that runs as slowly as is reasonable for any given document packet size (packet size reflecting the number of pages within the packet and the time required to print the packet). The speed of the moving means or folder 15 is not normally altered by the subject system. For illustrative purposes only and not by limitation, each document packet will be a billing statement or bill. Since, in actual practice, most bills are large enough (require a significant amount of time to print) that the inserter would run too slowly if the slowest possible inserter speed was used, most inserter motions are of a start/stop nature. That is, the inserter finishes a cycle and comes to a complete stop before the next bill arrives.

For smaller bills, the subject system inserter speed control algorithm will cycle the inserter at a speed that will catch the bill while the machine is still in motion from the last bill (controlled operation speed variations combined with adjustments as to when each insert cycle is initiated). This requires very precise control of the machine's speed and knowledge of the time between bills. Because of this, the actual details of the implementation varies among different printers and/or printer speeds for any one printer.

The following example incorporates the FIG. 2 state diagram with individual steps and illustrates how the subject speed control system functions for a printer that operates at approximately 340 ms between bill pages or a maximum of approximately 3 pages per second. Other time intervals are within the realm of the subject invention, including times necessary merely to move pages within a preprinted stack of documents to the inserter 25 via a moving means or folder 15. The subject invention programming within the controller permits the operational decisions necessary for the system to operate. For this example, it will be assumed that the following sequence of bills is produced by the printer:

REST-2 pages-2 pages-5 pages-1 page-1 page-2 pages-1 page-REST

Steps

1. The system is at rest, so the state diagram is at Circle 100 of FIG. 2 (all of the "Circle" references denote location in the FIG. 2 state diagram).

In Circle 100, the system is waiting for information for the next bill concerning the number of pages it contains. 2. As the sequence of bills example above indicates, a two page bill is coming first, followed by another two page bill, and then a five page bill. This allows time to do a start/stop motion for the first bill on the inserter 25, so the state diagram advances to Circle 200. The inserter 25 waits for the bill to arrive. It is noted that should the second or third bill be only one page in length (not shown in the above sequence example), then there would not be enough time to do a start/stop motion on the inserter and the state diagram would advance to Circle 500 instead of Circle 200. The procedure noted in Circle 500 is a "catch on the fly" profile that accommodates that there is no time to waste with a one page bill immediately following the one that is coming. After the "catch on the fly" procedure, the state diagram advances to Circle 800 discussed in detail below.

3. The current two page bill arrives at the inserter 25. The state diagram advances to Circle 300.

4. Select a speed for the inserter that results in an approximately 700 ms cycle time. Given the approximately 340 ms timing of the proposed printer, the 700 ms results in continuous motion for a stream of two page bills. The state diagram advances to Circle 700.

5. Noting the above sequence of bills, another two page bill is coming to the inserter 25. The state diagram advances to Circle 200.

6. The current two page bill arrives at the inserter 25. The state diagram advances to Circle 300.

7. The same inserter speed as in step 4 is used again for this two page bill. The inserter 25 has not come to a complete stop, therefore, the resulting cycle time is less than approximately 700 ms. This results in making up some of the error introduced by not completing the cycle before the arrival of this bill. If there was a long stream of two page bills, the error would eventually be eliminated and the inserter 25 would stop before the next bill arrived. This technique is utilized for two and three page bills and results in a much smoother motion of the inserter 25. For example, see the second timing graph or diagram discussed below and seen in FIG. 3*b*. The state diagram advances to Circle 700.

8. The controller detects that a five page bill is coming. This five page bill is followed by a one page bill Thus, there is no time to use a start/stop motion by the inserter 25 on the five page bill before the one page bill arrives. The state diagram advances to Circle 1000.

9. The controller 20 records or stores the time at which the five page bill leaves the folder 15. This time is used for adaptive speed control in step 12 below. The controller selects a speed that results in the inserter 25 running at full speed when the five page bill arrives at the inserter 25. The full speed start times and velocities are carefully calculated to make sure that the inserter 25 will never exceed the top speed of approximately one cycle/340 ms, for the exemplary printer 10. Because it takes the inserter 25 more than approximately 340 ms to accelerate to full speed from a complete stop, an empty slot (in the conveyor 28 sequence) will be created before the five page bill arrives at the inserter 25. The state diagram advances to Circle 800.

10. The five page bill arrives as the inserter 25 reaches full speed and is at rotational position denoted as "0" which is needed to catch the bill. The state diagram advances to Circle 600.

11. The first one page bill is coming to the inserter 25. The controller 20 detects and stores the time at which the one page bill exits the folder 15. Since the bill is only one page, no time exists to slow the inserter 25 down. The state diagram advance to Circle 900.

12. The controller 20 fine tunes the speed of the inserter 25 to generate a suitable speed profile. This fine tuning accommodate the fact that the one page bill is not exactly 340 ms behind the five page bill (transport, folding, and like variations introduce this difference in timing). The times recorded for the actual exiting of bills from the folder 15 are employed in this process. The state diagram advances to Circle 800.

13. The first one page bill arrives at the inserter 25. The inserter 25 is at rotational position denoted as "0." The state diagram advances to Circle 600.

14. The second one page bill (see sequence noted above) is detected as coming. The controller 20 stores the time at which the bill exits the folder 15. The state diagram advances to Circle 900.

15. Once again the controller 20 adjusts the speed of the inserter 25 to allow for the fact that the bills are not exactly 340 ms apart. The state diagram advances to Circle 800.

16. The second one page bill arrives at the inserter 25. The inserter 25 is at rotational position denoted as "0". The state diagram advances to Circle 600.

17. The controller 20 notes that a two page bill is coming next from the printer 10. If the bill after this two page bill was greater than one page (in fact it is one page), the inserter 25 would be directed to slow down. But, if the inserter 25 slows down for the two page bill, it would not be able to speed back up in time for the actual one page bill that follows it in the exemplary sequence. The controller 20 records or stores the exit time from the folder 15 for the two page bill. The state diagram advances to Circle 900.

18. The controller 20 makes the fine tuning adjustments to the speed of the inserter 25 to allow for the fact that the bills are not exactly 680 ms (2×340 ms) apart. In this example, since the next bill is a two page bill, an empty slot will occur in the conveyor 28 of the inserter 25. The state diagram advances to Circle 800.

19. The two page bill arrives at the inserter 25. The state diagram advances to Circle 600.

20. The controller 20 notes that another one page bill is coming, but since there is no bill behind it. This still requires a full speed cycle, since this bill will arrive at the inserter 25 340 ms after the previous one. The controller 20 records or stores the time at which the bill exits the folder 15. The state diagram advances to Circle 900. (Had there been time to do a start/stop because of the next bill being of sufficient size, the controller 20 would have recorded the time at which the bill exited the folder and the state diagram would have advanced to Circle 400. Following Circle 400, the state diagram would have then proceeded to Circle 300 and then Circle 700 before ending at Circle 100.)

21. Once again the controller 20 adjusts the speed of the inserter 25 to allow for the fact that the bills are not exactly 340 ms apart. The state diagram advances to Circle 800.

22. The last one page bill arrives at the inserter 25. The inserter 25 is at rotational position denoted a "0". The state diagram advances to Circle 600.

23. No more bill messages arrive, therefore, the inserter 25 comes to a stop or rest. The state diagram advances to Circle 100.

Figure 3A:
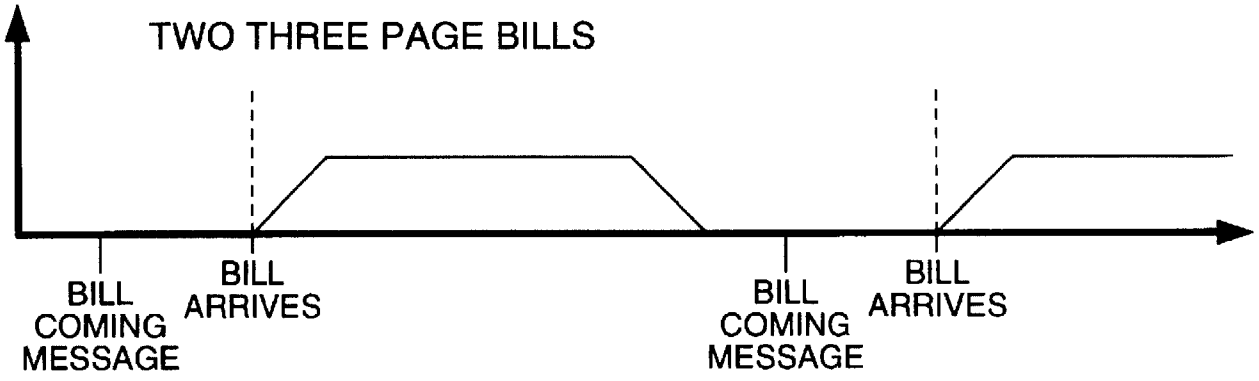
FIG. 3*a* is a timing graph for the subject invention operating on a first three page packet followed by a second three page packet.
Figure 3B:
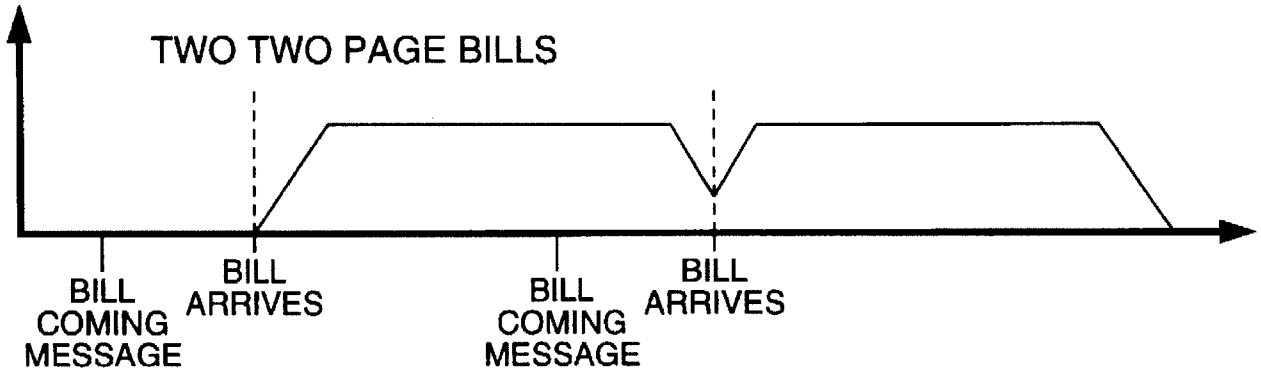
FIG. 3*b* is a timing graph for the subject invention operating on a first two page packet followed by a second two page packet.
Figure 3C:
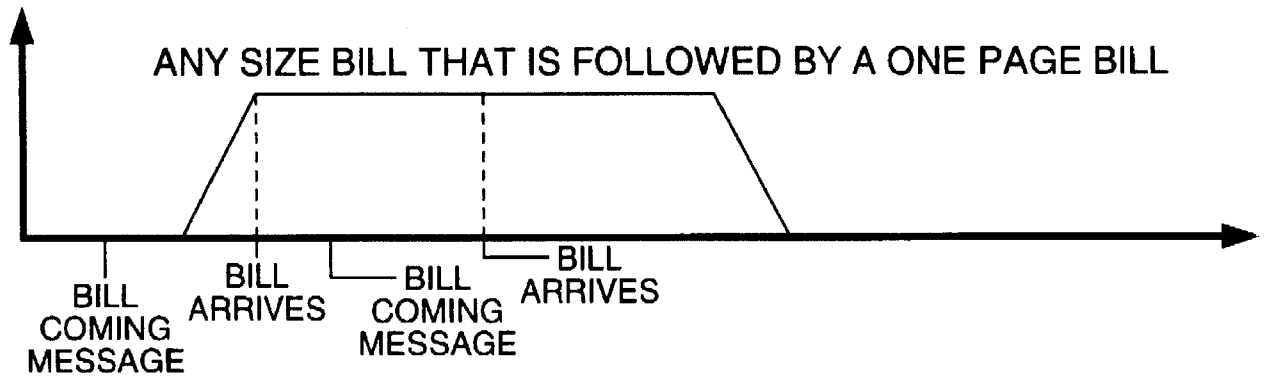
FIG. 3*c* is a timing graph for the subject invention operating on a first packet having any number of pages followed by a second one page packet.

To further clarify the subject inventions, three timing diagrams are presented in FIGS. 3*a*, 3*b*, and 3*c*. Each diagram has inserter velocity on the vertical axis and time on the horizontal axis. FIG. 3*a* illustrates a typical timing profile utilized by the subject system for processing two sequential three page bills. The inserter has sufficient time to operate under the stop/start mode and the velocity of the inserter is selected to be as slow as practicable.

FIG. 3*b* depicts a typical timing profile used by the subject system for handling two sequential two page bills (see step 7 above). Since less time is available between bills, the inserter velocity is higher in FIG. 3*b* case than in the FIG. 3*a* situation. The second bill is caught as the inserter is in the process of accelerating.

FIG. 3*c* portrays the situation in which the initial bill in a two bill sequence is of any page size and second bill is a one page bill. Since the one page bill arrives only about 340 ms after the first bill, no time exists for a start/stop motion. The overall velocity for this option is the highest of the three depicted cases.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A system for coordinating an operational speed of a document transferring device that receives incoming packets of documents having a predetermined number of document pages within each of the packets with an interval of time required to receive each incoming packet, comprising:

a) a document transferring device and b) means for coordinating the operational speed of said document transferring device with the interval of time required to receive each incoming packet, wherein said coordinating means is a computer programmed to implement the steps:

i) determining for a first incoming packet a number of document pages within said first incoming packet;

ii) establishing for a second incoming packet following said first incoming packet a number of document pages within said second incoming packet; and iii) adjusting the operational speed of the transferring device based on said page determinations for both said first and said second incoming packets.

2. For use with an inserter apparatus that receives incoming packets of printed documents, with each of the packets having a predetermined number of pages, a system for coordinating an operational speed of the inserter with the period of time required to generate each incoming packet, comprising:

a) a printer for generating the pages within each packet;

b) an inserter for inserting each of the packets into a mailing envelope; and c) computer means for coordinating the operational speed of the envelope inserter with the interval of time required by the printer to generate each incoming packet.

3. A speed coordination system according to claim 2, wherein said computer means is programmed with steps comprising:

a) determining for an incoming packet the number of document pages within said incoming packet;

b) initiating operation of the inserter based on said page number determination; and c) adjusting the operational speed of the inserter based on said page number determination.

4. A speed coordination system according to claim 2, wherein said computer means is programmed with steps comprising:

a) determining for a first incoming packet the number of document pages within said first incoming packet;

b) establishing for a second incoming packet following said first incoming packet the number of document pages within said second incoming packet; and c) adjusting the operational speed of the inserter based on said page number determination for both said first and said second incoming packets.

5. A system for coordinating an operational speed of an envelope inserter receiving incoming packets containing a predetermined number of document pages with an interval of time required to generate each incoming packet, comprising:

a) means for printing the document pages within each of the packets and b) computer means for coordinating the operational speed of the envelope inserter with the interval of time required by the printing means to generate each incoming packet, wherein said computer means is programmed with steps comprised of:

determining for an incoming packet the number of document pages within said incoming packet;

initiating operation of the inserter based on said page number determination; and adjusting the operational speed of the inserter based on said page number determination.

6. A system for coordinating an operational speed of an envelope inserter receiving incoming packets containing a predetermined number of document pages with an interval of time required to receive each incoming packet, comprising:

a) an envelope inserter and b) computer means for coordinating the operational speed of said envelope inserter with the interval of time required to receive each incoming packet, wherein said coordinating means is a computer programmed to implement the steps:

i) determining for a first incoming packet the number of document pages within said first incoming packet;

ii) establishing for a second incoming packet following said first incoming packet the number of document pages within said second incoming packet; and iii) adjusting the operational speed of the inserter based on said page number determination for both said first and said second incoming packets.

7. A speed coordination system according to claim 6, further comprising the steps of:

a) ascertaining for at least one additional incoming packet following said second incoming packet the number of document pages within said additional incoming packet and b) adjusting further the operational speed of the inserter based on said page determination for said additional incoming packet.

8. A system for coordinating an operational speed of an envelope inserter receiving incoming packets containing a predetermined number of document pages with an interval of time required to generate each incoming packet, comprising:

a) means for printing the document pages within each of the packets and b) computer means for coordinating the operational speed of the envelope inserter with the interval of time required by the printing means to generate each incoming packet, wherein said coordinating means is a computer programmed to implement the steps:

determining for a first incoming packet the number of document pages within said first incoming packet;

establishing for a second incoming packet following said first incoming packet the number of document pages within said second incoming packet; and adjusting the operational speed of the inserter based on said page number determination for both said first and said second incoming packets.

9. A speed coordination system according to claim 8, further comprising the steps of:

a) ascertaining for at least one additional incoming packet following said second incoming packet the number of document pages within said additional incoming packet and b) adjusting further the operational speed of the inserter based on said page determination for said additional incoming packet.

10. A system for coordinating an operational speed of a document transferring device that receives incoming packets of documents having a predetermined number of document pages within each of the packets with an interval of time required to generate each incoming packet, comprising:

a) means for generating the document pages within each of the packets and b) means for coordinating the operational speed of the document transferring device with the interval of time required to generate each incoming packet, wherein said coordinating means is a computer programmed to implement the steps:

i) determining for a first incoming packet a number of document pages within said first incoming packet;

ii) establishing for a second incoming packet following said first incoming packet a number of document pages within said second incoming packet; and iii) adjusting the operational speed of the transferring device based on said page determinations for both said first and said second incoming packets.

11. A system for coordinating an operational speed of an envelope inserter receiving incoming packets containing a predetermined number of document pages with an interval of time required to generate each incoming packet, comprising:

a) means for printing the document pages within each of the packets and b) computer means for coordinating the operational speed of the envelope inserter with the interval of time required by the printing means to generate each incoming packet.

12. A speed coordination system according to claim 11, wherein said computer means is programmed with steps comprised of:

a) determining for an incoming packet the number of document pages within said incoming packet;

b) initiating operation of the inserter based on said page number determination; and c) adjusting the operational speed of the inserter based on said page number determination.

13. A speed coordination system according to claim 11, wherein said coordinating means is a computer programmed to implement the steps:

a) determining for a first incoming packet the number of document pages within said first incoming packet;

b) establishing for a second incoming packet following said first incoming packet the number of document pages within said second incoming packet; and c) adjusting the operational speed of the inserter based on said page number determination for both said first and said second incoming packets.

14. A speed coordination system according to claim 13, further comprising the steps of:

a) ascertaining for at least one additional incoming packet following said second incoming packet the number of document pages within said additional incoming packet and b) adjusting further the operational speed of the inserter based on said page determination for said additional incoming packet.

15. A system for coordinating an operational speed of a document transferring device that receives incoming packets of documents having a predetermined number of document pages within each of the packets with an interval of time required to generate each incoming packet, comprising:

a) means for generating the document pages within each of the packets and b) means for coordinating the operational speed of the document transferring device with the interval of time required to generate each incoming packet, wherein said coordinating means is a computer with programming comprised of the steps:

determining for a first incoming packet a number of document pages within said first incoming packet;

establishing for a second incoming packet following said first incoming packet a number of document pages within said second incoming packet; and adjusting the operational speed of the transferring device based on said page determinations for both said first and said second incoming packets.

* * * * *

UNITED STATES PATENT AND TRADEMARK OFFICE
CERTIFICATE OF CORRECTION

PATENT NO : 5,724,791

DATED : March 10, 1998

INVENTOR(S) : Jeff M. Pishny, Marc J. Fagan, Remesh Kuruppath, Steven L. Mulkey, and Jonathan D. Emigh It is certified that error appears in the above-identified patent and that said Letters Patent is hereby corrected as shown below:

On title page, item 73 Assignee
replace "United States Computer Services, Sacramento, Calif."
with --International Billing Services, Inc., Rancho Cordova, Calif.--.

Signed and Sealed this

Third Day of November, 1998

*Attest:*

*Attesting Officer*

Bruce Lehman

BRUCE LEHMAN

*Commissioner of Patents and Trademarks*